US008844512B2

(12) United States Patent
Chezem et al.

(10) Patent No.: US 8,844,512 B2
(45) Date of Patent: Sep. 30, 2014

(54) COMBUSTION AIR SUPPLY APPARATUS FOR AN OVEN APPLIANCE

(75) Inventors: Michael Thomas Chezem, Georgetown, IN (US); Philip Ames Barber, Louisville, KY (US); John Mark Chilton, Campbellsburg, KY (US); Octavio Lugo Castillo, Queretaro (MX); Gerardo Picon, Queretaro (MX)

(73) Assignee: General Electric Company, Schenectady, NY (US)

( * ) Notice: Subject to any disclaimer, the term of this patent is extended or adjusted under 35 U.S.C. 154(b) by 1000 days.

(21) Appl. No.: 12/939,277

(22) Filed: Nov. 4, 2010

(65) Prior Publication Data

US 2012/0111316 A1 May 10, 2012

(51) Int. Cl.
*F24C 3/08* (2006.01)

(52) U.S. Cl.
CPC ..... *F24C 3/087* (2013.01)
USPC .... 126/39 E; 126/41 R; 126/39 C; 126/273 R

(58) Field of Classification Search
USPC ..... 126/41 R, 39 C, 273 R, 21 A, 37 R, 39 N, 126/21 R, 279, 39 E, 15 R
See application file for complete search history.

(56) References Cited

U.S. PATENT DOCUMENTS

| | | | | | |
|---|---|---|---|---|---|
| 1,844,768 | A | * | 2/1932 | Kirby | 126/39 C |
| 1,932,170 | A | * | 10/1933 | Bibb | 126/36 |
| RE27,254 | E | * | 12/1971 | Lamar | 126/279 |
| 3,704,703 | A | * | 12/1972 | Takase et al. | 126/39 C |
| 3,783,854 | A | * | 1/1974 | Hurko et al. | 126/21 R |
| 4,416,249 | A | * | 11/1983 | Reynolds et al. | 126/41 R |
| 4,461,950 | A | * | 7/1984 | Curless et al. | 392/492 |
| 5,460,157 | A | * | 10/1995 | Prabhu | 126/21 A |
| 5,622,100 | A | * | 4/1997 | King et al. | 99/386 |
| 6,537,065 | B1 | | 3/2003 | Shirali et al. | |

* cited by examiner

*Primary Examiner* — Avinash Savani
(74) *Attorney, Agent, or Firm* — Dority & Manning, P.A.

(57) ABSTRACT

An oven appliance is provided with an apparatus that supplies combustion air (i.e. primary air) to gas burner(s) of the oven appliance. The apparatus includes an air channel that provides for a flow of fresh, combustion air from the exterior of the oven appliance to a gas burner and, more particularly, to the shutter of a gas burner. The air channel can also be provided with a flame arrestor.

15 Claims, 2 Drawing Sheets

COMBUSTION AIR SUPPLY APPARATUS FOR AN OVEN APPLIANCE

FIELD OF THE INVENTION

The present invention relates to an apparatus that provides air to the gas burner of an oven appliance. More particularly, the present invention relates to an apparatus that channels combustion air from the exterior of an oven appliance to gas burner(s) used for heating the interior cooking chamber.

BACKGROUND OF THE INVENTION

For conventional gas oven appliances, combustion air (i.e. primary air) is provided to one or more gas burners through openings in the front and/or bottom of the appliance. Air flows through these openings and passes into the cabinet of the appliance, flows around and past internal components, and eventually to the gas burner(s). For such designs, the oven relies upon the relatively open spaces between internal components to allow enough air flow to supply combustion of a gaseous fuel in order to heat the oven.

To increase consumer appeal, it is desirable to increase the volume or space available for cooking in an oven. Such additional space allows for larger or multiple food items during cooking However, simply increasing the overall size of the appliance is generally not practical due to e.g., space constraints within a kitchen area and/or standardization of the sizes used for providing cabinet spaces or other locations within the kitchen areas.

Accordingly, one desirable way to increase the size of the appliance is to enlarge the volume of the cooking space within the oven while maintaining the overall size of the oven cabinet, which contains the cooking space and other components of the oven. Such an approach will necessarily compact the internal oven components into a more confined space between the oven's exterior cabinet and the walls of the internal cooking space. This means that the oven components are closer together and less space is available for the flow of combustion air from the exterior of the oven to the burner(s). The addition of various options to the oven only further decreases the availability of space for the flow of combustion air as well. For double ovens, the requirement of temperature dependence between the ovens even further limits the ability to channel air for the burners.

Accordingly, an oven appliance that includes an apparatus for feeding or channeling air to the burner(s) would be useful. Such an apparatus that allows for increasing the volumetric capacity of the cooking space of the oven while still providing for an adequate flow of combustion air to the burner would be particularly beneficial. An apparatus that also provides adequate combustion air while also allowing for the addition of options into the cabinet space of the oven would also be useful.

BRIEF DESCRIPTION OF THE INVENTION

Aspects and advantages of the invention will be set forth in part in the following description, or may be obvious from the description, or may be learned through practice of the invention.

In one exemplary embodiment, the present invention provides an oven appliance having an air supply apparatus. The oven appliance includes a cabinet defining at least one interior cooking chamber, with the cabinet also defining a rear wall. A door is connected to the front of the cabinet. At least one gas burner with a respective shutter is positioned within the cabinet to heat the cooking chamber. An air channel extends between the exterior of the cabinet to a position adjacent the shutter of the at least one gas burner. The air channel is configured for providing combustion air from the exterior of the cabinet to the at least one gas burner.

In another exemplary embodiment of the present invention, an oven appliance is provided that includes an air supply system. The oven appliance includes a cabinet defining a plurality of interior cooking chambers. The cabinet also defines a rear wall. A plurality of gas burners are included, each burner associated with a respective shutter. Each of the cooking chambers has at least one of the plurality of gas burners positioned within the cabinet so as to provide heat to each of the cooking chambers. A plurality of air channels are associated with the plurality of gas burners. Each of the plurality of air channels extends between an exterior of the cabinet to a position adjacent the shutter of one of the plurality of gas burners so as to provide combustible air from the exterior of the cabinet to each of the plurality of gas burners.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
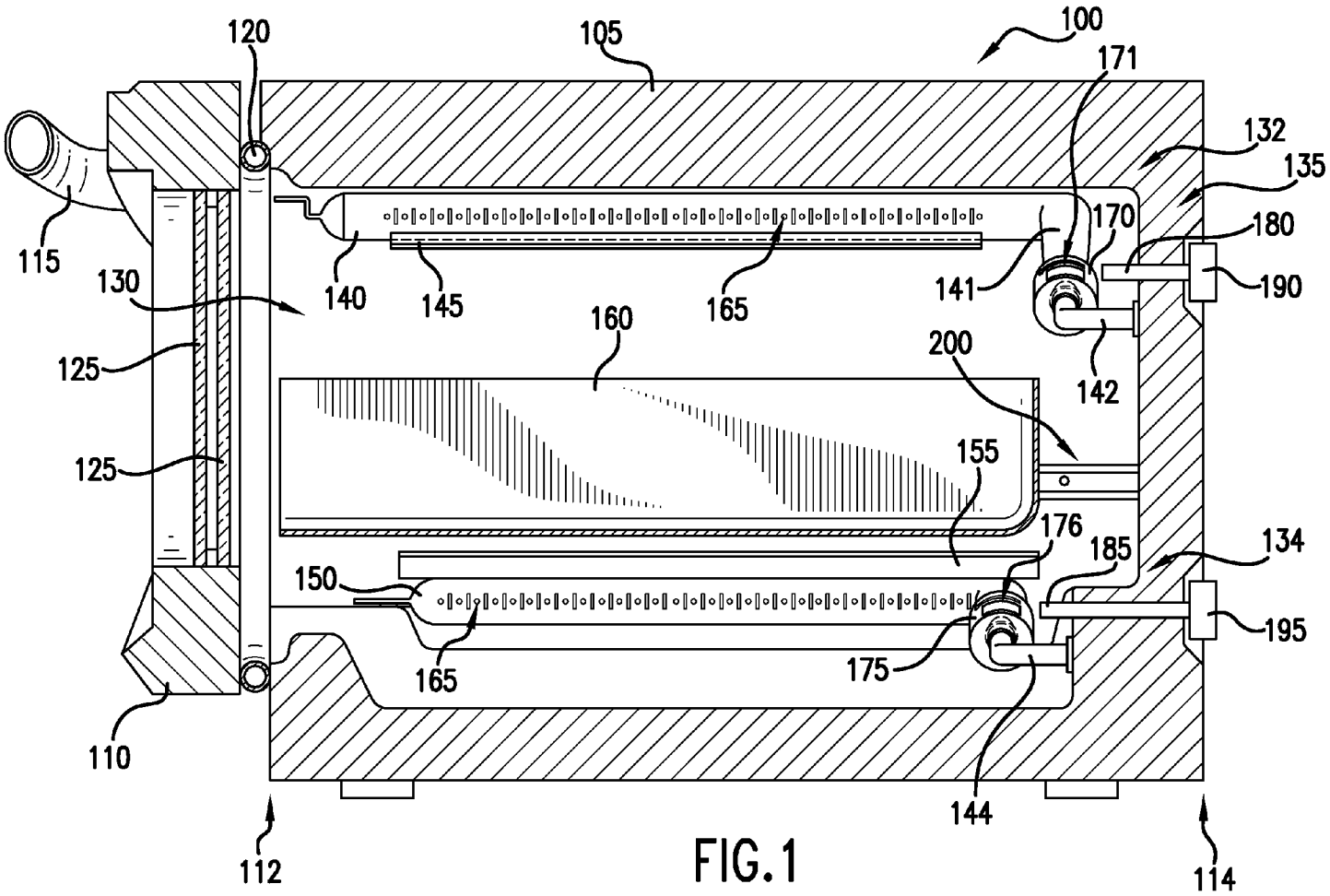
FIG. 1 provides a front, cross-sectional view of an oven appliance according to an exemplary embodiment of the present invention.

The present invention relates to an apparatus that provides combustion air (i.e. primary air) to the gas burner of an oven appliance. The apparatus includes a channel that provides for a flow of fresh, combustion air from the exterior of the oven appliance to a gas burner and, more particularly, to the shutter of a gas burner. The channel can also be provided with a spark arrestor. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
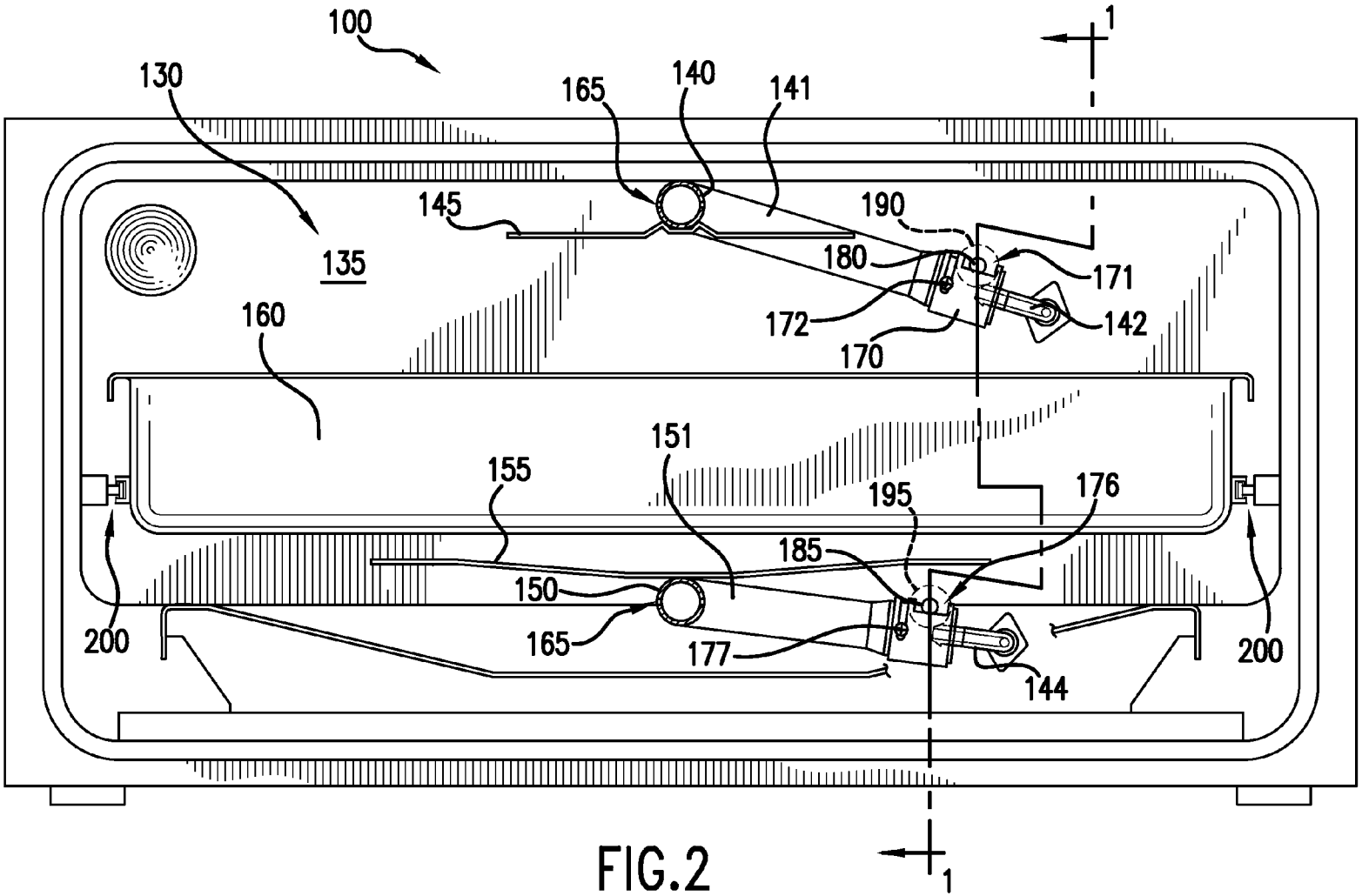
FIG. 2 provides a side, cross-sectional view of the exemplary embodiment of an oven appliance shown in FIG. 1.

FIGS. 1 and 2 illustrate an exemplary embodiment of a gas oven appliance 100 of the present invention. Oven 100 includes an insulated cabinet 105 that defines an interior cooking chamber 130 for the receipt of one or more food items to be cooked. It is desirable to maximize the volume of chamber 130 so that large and/or multiple food items may be placed within oven 100 at the same time. However, increasing the size of cooking chamber 130 without also increasing the size of cabinet 105 decreases the space available for other oven components, such as various consumer options.

Oven 100 include a door 110 hingedly attached to the front 112 of cabinet 105. Handle 115 allows for access to cooking chamber 130. Seal 120 provides for maintaining heat and cooking fumes within cooking chamber 130 when door 110 is closed as shown in FIG. 1. Double glass panes 125 provide for viewing the contents of cooking chamber 130 when door 110 is closed. A pan 160 is positioned in cooking chamber 130 for the receipt of food items. Pan 160 is slidably received onto rails 200 such that pan 160 may be conveniently moved into and out of cooking chamber 130 when door 110 is open. By way of example, an oven designer may wish to increase the size of cooking chamber 130 such that two pans 160 can be included therein.

Two gas burners 140 and 150 are provided to heat cooking chamber 130. Broil gas burner 140 is positioned at the top 132 of cooking chamber 130 and thereby provides heat from a position over pan 160, which is sometimes referred to as broiling. Broil gas burner 140 is supplied with a gaseous fuel by fuel line 142. Apertures 165 allow for the release of gaseous fuel for combustion. Shield 145 protects burner 140 from damage.

Similarly, lower gas burner 150 is positioned at the bottom 134 of cooking chamber 130 and thereby provides heat from a position below pan 160. Gas burner 150 is supplied with gaseous fuel by fuel line 144. Apertures 165 in lower burner 150 allow for the release of gaseous fuel for combustion. Lower shield 155 protects burner 150 from damage. It should be understood that the present invention may be used with various gaseous fuels such as propane and natural gas.

Burner 140 includes a gas orifice with shutter 170 while burner 150 includes a gas orifice with shutter 175. Shutter 170 is rotatable about a tubular portion 141 of broil burner 140 while shutter 175 is rotatable about a tubular portion 151 of burner 150. The rotation of each shutter 170 and 175 controls the size of openings 171 and 176 respectively, which controls the flow of combustion air into burners 140 and 150. Set screws 172 and 177 (FIG. 2) provide for fixing the position of shutters 170 and 175, respectively.

As shown more clearly in the side view of FIG. 1, an air channel 180 extends from the exterior of cabinet 105, through rear wall 135, and to a position that is adjacent to shutter 170. Similarly, an air channel 185 extends from the exterior of cabinet 105, through rear wall 135, and to a position that is adjacent shutter 175. Each air channel 180 and 185 is constructed from conduit or tubing so as to contain an internal passageway for the flow of fresh combustion air from the exterior of cabinet 105 to shutters 170 and 175. Each air channel 180 and 185 is also equipped with a flame arrestor 190 and 195, respectively, to prevent a flame from spreading outside of cabinet 105.

Accordingly, air channels 180 and 185 ensure that combustion air is provided for burners 140 and 150 regardless of the presence of additional components (such as various consumer options) within cabinet 105 and/or the enlargement of interior cooking chamber 130 within cabinet 105. In addition, because of air channels 180 and 185, oven 100 does not need openings along front 112 around door 110 for the passage of air towards the rear 114 of cabinet 105 to provide air to burners 140 and 150. Although shown as straight and horizontal, channels 180 and 185 can also be provided with turns e.g., elbows to provide additional flexibility for positioning within cabinet 105 while still ensuring that fresh combustion air is provided for burners 140 and 150.

Although the exemplary embodiment of FIGS. 1 and 2 has been described using an oven 100 with a single interior chamber 130, using the teachings disclosed herein it will be understood that the present invention may also be used with various other oven configurations. For example, the present invention may be used with a double oven or an oven having multiple, interior cooking chambers. In such case, multiple air channels can be provided in order to ensure the supply of combustion air to each burner. Furthermore, while air channels are preferably routed through the rear wall of the oven as described above with FIGS. 1 and 2, other configurations may be used. For example, air channels 180 and 185 could be routed through the sides or front 112 of cabinet 105 as well. By way of further example, embodiments of the present invention may be used with built-in type oven appliances, ovens that include a range top, and various other appliance configurations as well.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance having an air supply apparatus, comprising:

a cabinet defining at least one interior cooking chamber, said cabinet defining a rear wall;

a door connected to the front of said cabinet;

at least one gas burner with a respective shutter positioned within said cabinet to heat the cooking chamber, and an air channel extending continuously from an exterior of said cabinet, through the rear wall of said cabinet, and to a position adjacent the shutter of said at least one gas burner, said air channel configured for providing combustion air from the exterior of said cabinet to said at least one gas burner.

2. An oven appliance having an air supply apparatus as in claim 1, wherein said air channel comprises an open conduit extending continuously from the exterior of said cabinet, through the rear wall of said cabinet, and to a position adjacent the shutter of said at least one gas burner.

3. An oven appliance having an air supply apparatus as in claim 2, wherein said cooking chamber defines a top and a bottom, and wherein said at least one gas burner with its respective shutter is positioned near the top of the cooking chamber.

4. An oven appliance having an air supply apparatus as in claim 2, wherein the cooking chamber defines a top and a bottom, and wherein said at least one gas burner comprises a broil gas burner with a shutter positioned near the top of said cooking chamber and a lower gas burner with another shutter positioned near the bottom of the cooking chamber.

5. An oven appliance having an air supply apparatus as in claim 1, wherein said air channel further comprises a flame arrestor.

6. An oven appliance having an air supply apparatus as in claim 1, wherein said air channel comprises a tube.

7. An oven appliance having an air supply apparatus as in claim 5, wherein said flame arrestor is positioned within a recess in the rear wall of said cabinet.

8. An oven appliance having an air supply apparatus as in claim 1, wherein said air channel extends horizontally from the exterior of said cabinet, through the rear wall of said cabinet, and to a position adjacent the shutter of said at least one gas burner.

9. An oven appliance having an air supply apparatus, comprising:

a cabinet defining at least one interior cooking chamber, said cabinet defining a rear wall;

a door connected to the front of said cabinet;

at least one gas burner with a respective shutter positioned within said cabinet to heat the at least one cooking chamber; and a horizontal air channel extending continuously from an exterior of said cabinet, through the rear wall of said cabinet, and to a position adjacent the shutter of said at least one gas burner, said air channel configured for providing combustion air from the exterior of said cabinet to said at least one gas burner.

10. An oven appliance having an air supply apparatus as in claim 9, wherein said air channel comprises an open, horizontal conduit extending linearly and continuously from an exterior of said cabinet, through the rear wall of said cabinet, and to a position adjacent the utter of said at least one gas burner.

11. An oven appliance having an air supply apparatus as in claim 10, wherein said cooking chamber defines a top and a bottom, and wherein said at least one gas burner with its respective shutter is positioned near the top of the cooking chamber.

12. An oven appliance having an air supply apparatus as in claim 10, wherein the cooking chamber defines a top and a bottom, and wherein said at least one gas burner comprises a broil gas burner with a shutter positioned near the top of said cooking chamber and a lower gas burner with another shutter positioned near the bottom of the cooking chamber.

13. An oven appliance having an air supply apparatus as in claim 9, wherein said air channel further comprises a flame arrestor.

14. An oven appliance having an air supply apparatus as in claim 13, wherein said flame arrestor is positioned within a recess in the rear wall of said cabinet.

15. An oven appliance having an air supply apparatus as in claim 9, wherein said air channel comprises a tube.

* * * * *